United States Patent [19]

Vaden

[11] Patent Number: 4,607,905

[45] Date of Patent: Aug. 26, 1986

[54] MODULAR PLUG

[75] Inventor: James L. Vaden, Black Mountain, N.C.

[73] Assignee: Brand-Rex Company, Willimantic, Conn.

[21] Appl. No.: 724,513

[22] Filed: Apr. 18, 1985

[51] Int. Cl.[4] ..... H01R 13/50

[52] U.S. Cl. ..... 339/176 M; 339/103 M

[58] Field of Search ..... 339/98, 99 R, 103 R, 339/103 M

[56] References Cited

U.S. PATENT DOCUMENTS

| | | | |
|---|---|---|---|
| 4,211,462 | 7/1980 | Wolfthal | 339/103 M |
| 4,461,923 | 7/1984 | Bogese | 339/99 R X |
| 4,506,944 | 3/1985 | Brennan et al. | 339/99 R X |
| 4,516,825 | 5/1985 | Brennan et al. | 339/99 R X |

*Primary Examiner*—Eugene F. Desmond

*Attorney, Agent, or Firm*—McCormick, Paulding and Huber

[57] ABSTRACT

An FCC-type modular plug, including a dielectric housing receiving a plurality of conductors. The conductors are terminated by a plurality of electrical contacts. Individual conductors are received between barriers which rise from the floor and between barriers descending from the ceiling inside of the connector in the vicinity where the conductors are terminated by the contacts. Part of each of the barriers is inclined to the ceiling and floor, respectively. The barriers form guiding grooves which guide the conductors into position for termination by insulation displacing contacts. A strain relief mechanism incorporates ratchet teeth for allowing variable movement into cable clamping position.

4 Claims, 9 Drawing Figures

MODULAR PLUG

BACKGROUND OF THE INVENTION

This invention relates to electrical connectors. More particularly, it relates to modular FCC-type electrical plugs primarily used in the communications industry. The Federal Communications Commission (FCC) has issued regulations standardizing the outer dimensions of so-called modular plugs which are primarily used to terminate small multi-conductor cables for making various electrical connections.

Examples of plugs having these FCC regulated outer dimensions are shown in U.S. Pat. No. 4,431,246, issued to Vaden, assigned to the Brand-Rex Company, assignee of this application, and U.S. Pat. No. 4,148,539, issued to Hardesty, assigned to Western Electric Company, Incorporated. The disclosures set forth in the above two patents are hereby incorporated herein by reference.

While the outer dimensions of the plug have been standardized, the FCC has permitted substantial leeway in the design and improvement in the inside portions of modular plugs. An example of a prior art plug is shown in cross-section in FIG. 1 of this application. Plug 10 is made of a dielectric plastic material and includes a first opening 12 for receiving a multi-conductor cable and a second opening 14 for receiving a plurality of contacts to terminate the conductors in the cable. The plug 10 also includes an opening 13 designed to prevent a bubble which sometimes forms when the plastic is molded. A typical general arrangement of such a second opening used in the termination of contacts to conductors is better seen in reference to FIG. 6. Referring again to FIG. 1, the floor 16 is smooth along the wire entry portion of its length. This has led to problems in aligning the conductors to be terminated to its proper contact, in that the conductors are somewhat free to move about. This problem is compounded in that the prior art plug does not provide a mechanism for guiding the individual conductors into their proper positions during the early stage of the insertion of the cable into the connector. This has, in the past, resulted in frequent rejection of the plugs during the inspection in the manufacturing process.

Furthermore, the prior art plug includes conductor strain relief mechanism 18, which weakens the overall structure of the plug, and is believed to be somewhat superfluous in view of the cable strain relief mechanism 20 and the increased retention provided by the three-tine contactor disclosed in the above-mentioned U.S. Pat. No. 4,431,246.

OBJECTS OF THE INVENTION

It is therefore one object of this invention to provide an improved modular plug.

It is another object to provide an improved modular plug which is adapted to terminate electrical conductors in various sizes in either round or flat cable of various diameters and thicknesses.

It is another object to provide a housing for use as a modular plug which enables consistent termination of contacts to electrical conductors.

It is still another object to provide a modular plug which is stronger than prior art plugs.

SUMMARY OF THE INVENTION

In one form of this invention, there is provided dielectric housing for enabling electrical connections. The housing is made of a dielectric material and preferably plastic. The housing includes a first opening forming a channel for receiving an electrical cable having a plurality of conductors. A second opening is provided in the housing for receiving a plurality of electrical contacts. The contacts are terminated to the conductors within the housing. The channel for receiving the cable has a floor with a plurality of spaced apart lands rising from a portion of the floor. Individual conductors are received between at least some of the lands whereby the lands aid in the alignment of the conductors and act as barriers between the conductors.

BRIEF DESCRIPTION OF THE DRAWINGS

The subject matter which is regarded as the invention is set forth in the appended claims. The invention itself, however, together with the further objects and advantages thereof, may be better understood by reference to the following description, taken in conjunction with the accompanying drawings, in which:

DESCRIPTION OF THE PREFERRED EMBODIMENT

Figure 2:
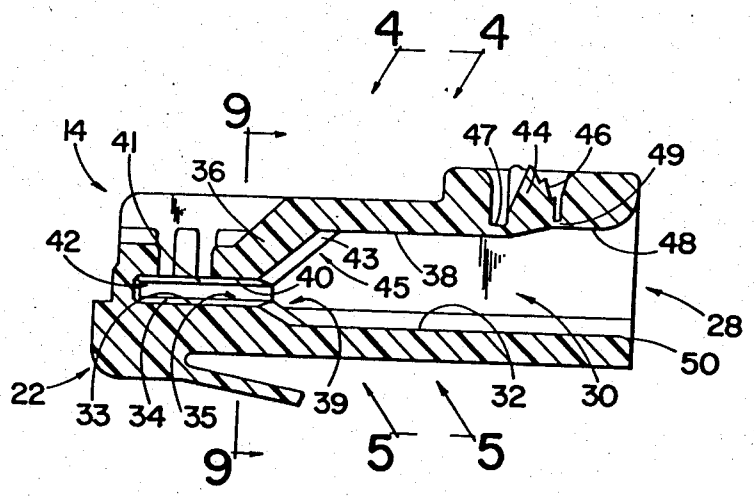
FIG. 2 is a sectional view of showing the dielectric housing of the subject invention.
Figure 4:
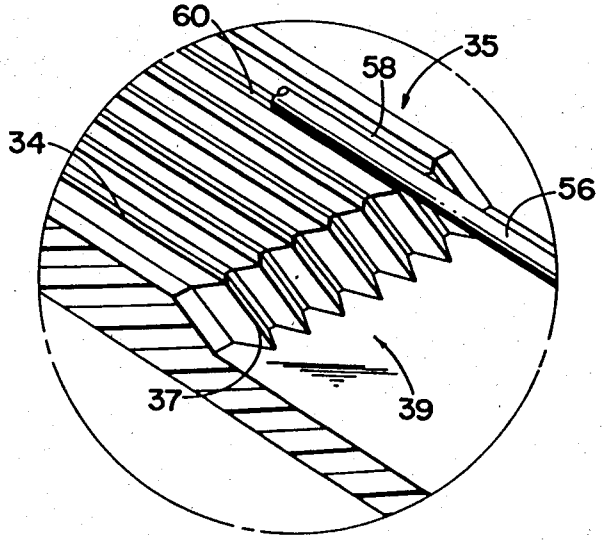
FIG. 4 is a partial pictorial view of a portion of the housing of FIG. 2, as indicated by arrows 4, but with the top portion of the housing removed, showing the barriers within the housing with one conductor between two of the barriers.
Figure 3:
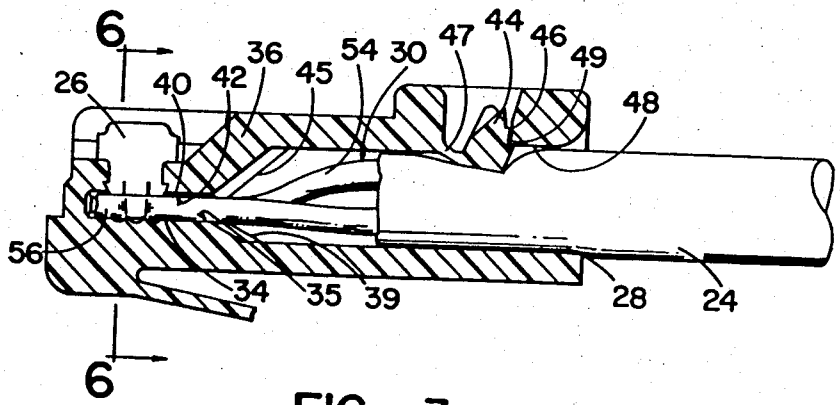
FIG. 3 is a sectional view of the housing of FIG. 2, together with an electrical cable having been terminated by electrical contacts.
Figure 9:
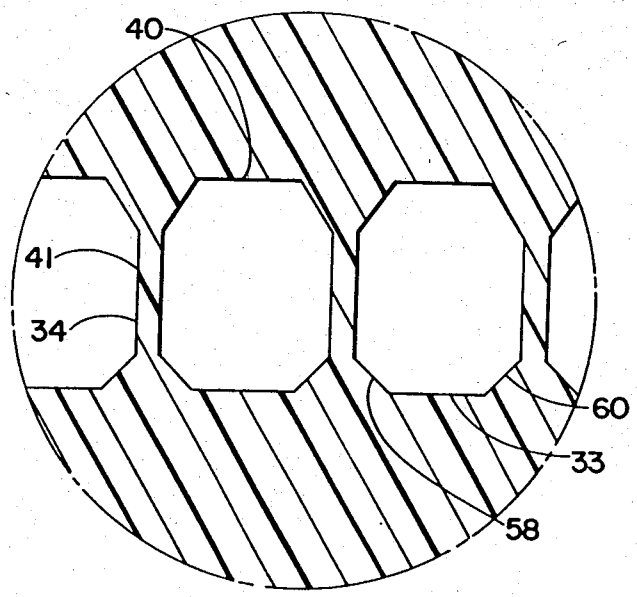
FIG. 9 is a sectional view of a portion of FIG. 2 taken through lines 9—9.

Referring now more particularly to FIG. 2, there is provided dielectric housing 22, which is adapted to receive cable 24 and contacts 26 as shown in FIG. 3. Referring again to FIG. 2, housing 22 has a first opening 28 in the rear of the plug, forming channel 30, which extends along most of the length of the housing. Channel 30 includes floor 32 and a raised or stepped portion thereof 33. A plurality of raised portions or barriers 34 which extend upwardly from the stepped portion of the floor 33, form guide grooves 35 therebetween. Inclined portions or barriers 37 are continuations of barriers 34 and form guide grooves 39 therebetween which are extensions of guide grooves 35 albeit at an angle thereto. The alignment or guide grooves 35 and 39 are better illustrated in FIGS. 4 and 9.

Figure 5:
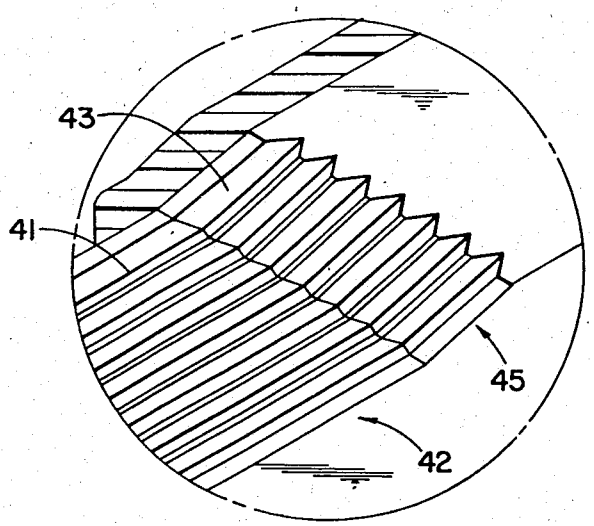
FIG. 5 is a partial pictorial view of a portion of the housing of FIG. 2, as indicated by arrows 5, with the bottom of the housing taken away, showing the conductor guides.

Referring again to FIG. 2, channel 30 also includes upper ceiling 38 and lower ceiling 40. Channel 30 further includes a plurality of portions or barriers 41 which extend downwardly from the lower ceiling 40, forming horizontal alignment grooves 42 therebetween. A plurality of downwardly extending portions or barriers 43, forming alignment grooves 45 therebetween connect the upper ceiling to the lower ceiling at an angle or inclined slope. The alignment or guide grooves 42 and 45 in the ceiling of housing 22 are illustrated in more detail in FIGS. 5 and 9.

The horizontal guide grooves 35 and inclined guide grooves 39 form continuous channels bending at the intersection between the two and, with guide grooves 42 and 45, form paths for inserting multiconductor cables into the channel 30. The grooves serve as channels for individual conductors to be guided into position for insertion of the contacts 26. This positive aid to locating the individual conductors in the proper grooves reduces significantly the number of rejected plugs.

Housing 22 further includes second opening 14 for receiving a plurality of electrical contacts. Adjacent to second opening 14 is solid plastic beam 36 which adds strength to the housing.

The housing 22 further includes strain relief member 44, including a plurality of ratchet teeth 46. Strain relief member 44 is hinged at 47, and is adapted to be severed from the housing at 49 by a spring-loaded punching tool (not shown) and pressed down upon cable 24 as shown in FIG. 3. Depending upon the size of the cable 24, one of the ratchet teeth 46 contacts edge 48 holding the strain relief member 44 firmly against cable 24. With multiple teeth on the strain relief member 44, cables of varying diameter can be clamped without passing entirely through the insulating coating and shorting a conductor or even severing one or more conductors as is possible with the prior art plug having the strain relief member 18 shown in FIG. 1. The opening 28 includes rounded portion 50, so that round cable more easily enters channel 30.

Figure 1:
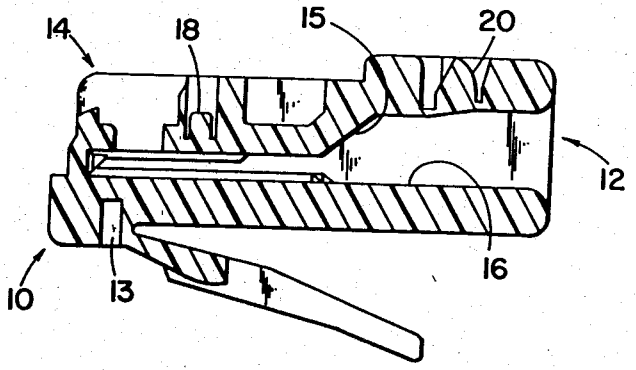
FIG. 1 PRIOR ART
FIG. 1 is a sectional view of a prior art modular plug, such as the plugs described in U.S. Pat. Nos. 4,431,246 and 4,148,539.

As can be seen from comparing FIGS. 1 and 2, opening 13 in the bottom of the housing has been eliminated in FIG. 2 in order to add strength to the housing.

Referring now more particularly to FIG. 3, the housing described in FIG. 2 is shown with the insulated conductors 54 of cable 24 being inserted into channel 30 prior to being terminated to contacts 26. As can be seen, cable 24 in this embodiment is round cable; thus, the conductors 54 which extend from the end of the cable come out of the cable along substantially the full height of channel 30.

In comparing the prior art housing in FIG. 1 to the housing of FIG. 3, it should be noted that plastic member 15 has been removed in FIG. 3. Plastic member 15 would tend to crowd the conductors when round cable is used, and in some cases actually prevent the cross-over of the conductors so that they could not be properly aligned and terminated to the contacts. With plastic member 15 having been removed, there is much more room for cross-over of the conductors and, furthermore, a larger variety of different sizes of cable may be utilized.

Again comparing FIG. 1 to FIG. 3, it should be noted that conductor strain relief 18 has been eliminated in FIG. 3, and a solid strut 36 has been provided in lieu thereof, which strengthens the housing. As cable 24 is inserted into first opening 28, the ends of the conductors 54 will strike inclined guide grooves 39 or 45. These inclined guiding groove coact to guide individual conductors 56 into the horizontal grooves 35 and 42 between lands 34 and 40, respectively. Thus, conductor 56 lies in one of the grooves between land 58 and land 60. Thus, each conductor is isolated from the other, and is properly aligned with contacts 26 for terminating the conductors. This may be also seen in reference to the FIG. 6, where contact 26 is terminated to conductor 56 between land 58 and land 60.

Figure 6:
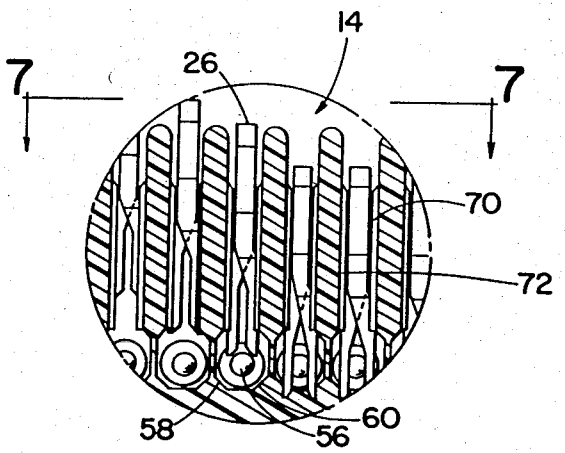
FIG. 6 is a sectional view of a portion of FIG. 3 taken through lines 6—6.
Figure 8:
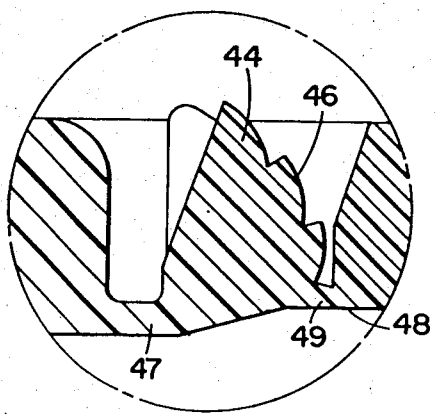
FIG. 8 is a sectional view of the strain relief mechanism.
Figure 7:
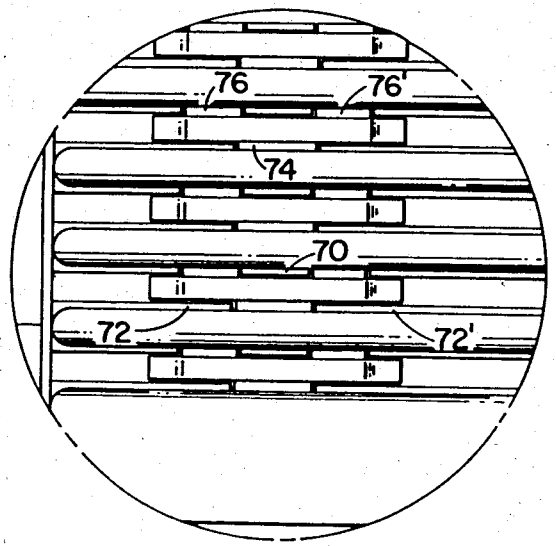
FIG. 7 is a sectional view of FIG. 6 taken through lines 7—7.

In FIGS. 6 and 7 are shown lands or ribs 70, 72 and 72' which are formed on opposite walls of each space receiving a contact 26. The lands 70, 72 are dimensioned so as to leave a space between opposite lands very close to the thickness of a contact 26. In this way, the contact is held closely between the lands and will not wobble or lean, but will slide cleanly into place over the centered conductors 56. Furthermore, the lands or ribs are arranged in longitudinally spaced alternate series on one and the opposite wall of each contact receiving opening. Thus, two lands 72 and 72' are placed on the side of the longitudinal axis of the contact receiving opening on which the single blade 74 of the contact 26 is located and the single land 70 is placed on the side of the longitudinal axis of the contact receiving opening on which the outside blades 76 and 76' of contact 26 so that correct placement of each contact (all aligned in the same direction) is automatically assured.

Thus, there has been provided an improved dielectric housing, forming a FCC modular plug that overcomes many of the problems of the prior art plugs.

From the foregoing description of the illustrative embodiment of the invention, it will be apparent that many modifications may be made therein. It will be understood, therefore, that this embodiment of the invention is intended as an examplification only, and that the invention is not limited thereto. It is to be understood, therefore, that it is intended that the below claims are to cover all modifications that shall fall within the true spirit and scope of the invention.

I claim:

1. A modular electrical connector comprising an elongated dielecting housing defining an elongated generally longitudinally extending first channel terminating at an opening in the rear end of said housing for receiving an electrical cable having a plurality of conductors, said channel having generally opposing floor and ceiling surfaces, the rear portions of said floor and ceiling surfaces being generally parallel to each other, the forward end portions of said floor and ceiling surfaces being inclined to the longitudinal axis of said housing and converging toward each other in the direction of the forward end of said housing, a plurality of generally longitudinally extending lands projecting from the inclined forward end portions of said floor and ceiling surfaces and defining generally longitudinally extending grooves therebetween, a transversely spaced apart series of longitudinally extending conductor receiving passageways formed in said housing forward of said channel and equal in number to said grooves, each of said passageways being defined by longitudinally extending lands and aligned with and forming forward extensions of an opposing pair of said grooves defined by said inclined forward end portions of said floor and ceiling surfaces, and a transversely spaced apart series of contact receiving openings formed in a forward end portion of said housing equal in number to said passageways, each of said contact receiving openings communicating with an associated one of said passageway, said inclined forward end portions of said floor and ceiling surfaces comprising means for engaging the leading end portions of the conductors of an associated cable to align each of the leading end portions with an associated one of said conductor receiving passageways before the leading end portions reach said passageways and for guiding the leading end portions into said passageway as the cable is inserted into said housing through said opening in the rear end of said housing.

2. A dielectric housing member as set forth in claim 1, wherein each of said lands has a generally triangular cross section.

3. A dielectric housing member as set forth in claim 1, wherein said lands extend from a position near said second opening where said contacts are received toward said first opening.

4. A modular connector as set forth in claim 1 wherein each of said contact receiving openings is defined by a pair of opposing longitudinally disposed and generally vertically extending walls having a longitudinally spaced apart alternate series of generally vertically extending ribs projecting inwardly therefrom for engaging opposite sides of a contact received therebetween.

* * * * *